US006352261B1

(12) United States Patent
Brown

(10) Patent No.: US 6,352,261 B1
(45) Date of Patent: Mar. 5, 2002

(54) CASINO CHIP

(76) Inventor: Darrell L. Brown, P.O. Box 9077, Torrance, CA (US) 90508

( * ) Notice: Subject to any disclaimer, the term of this patent is extended or adjusted under 35 U.S.C. 154(b) by 0 days.

(21) Appl. No.: 09/734,486

(22) Filed: Dec. 11, 2000

(51) Int. Cl.[7] ..... A63F 3/00
(52) U.S. Cl. ..... 273/288; 40/27.5; D21/386
(58) Field of Search ..... 273/288–291, 273/148 R, 153 R, 156, 153 S, 440, 447, 449; 40/27.5; D21/51, 53, 386

(56) References Cited

U.S. PATENT DOCUMENTS 2,695,174 A 11/1954 Cusano et al.
3,924,857 A * 12/1975 Christensen
3,968,582 A * 7/1976 Jones
4,435,911 A * 3/1984 Jones
D280,429 S * 9/1985 Thomson
D288,944 S * 3/1987 Duguid
5,166,502 A * 11/1992 Rendleman
5,211,403 A 5/1993 Ostrander
5,219,162 A * 6/1993 Orbanes
5,406,264 A * 4/1995 Plonsky
5,676,376 A 10/1997 Valley
5,794,532 A * 8/1998 Gassies
5,803,459 A 9/1998 Casas-Salat
5,895,321 A 4/1999 Gassies et al.
6,021,949 A * 2/2000 Boiron

* cited by examiner

*Primary Examiner*—Benjamin H. Layno
*Assistant Examiner*—V K Mendiratta
(74) *Attorney, Agent, or Firm*—Oppenheimer Wolff & Donnelly LLP

(57) ABSTRACT

A casino chip of a stated value having a central transparent portion with at least one discrete particle therein, such as a precious or semi-precious metallic element. When shaken, the chip simulates the rattling of a pair of dice to a player.

10 Claims, 2 Drawing Sheets

CASINO CHIP

BACKGROUND OF THE INVENTION

1. Field of the Invention

The invention relates to casino chips; and, more particularly, to a casino chip having a transparent center portion with at least one discrete particle therein that rattles or moves when the chip is shaken.

2. Related Art

Casino chips of differing values are well known. Such chips usually are round and of a predetermined diameter and thickness. They generally have indicia thereon, such as printing or embossing, stating the value of the chip.

Generally, casino chips are issued by the casino in which they are intended to be used. Some players like to keep such chips for souvenirs. They would be more likely to keep such chips for souvenirs if they had a value outside of the casino.

Gamblers are also very superstitious. For example, one watching a craps table at a casino will see the roller of the dice shake the dice in his or her hand making them clatter together prior to rolling the same.

There is a need for a casino chip that has both value as a chip in the casino and as a souvenir outside the casino. There is also a need for a casino chip that can be used by a gambler as a lucky piece or the like.

SUMMARY OF THE INVENTION

It is an object of this invention to provide a casino chip that rattles or makes a noise or moves when shaken creating excitement for a gambler.

It is a further object of this invention to add value to a casino chip aside from its value within the casino in which it is used thus enhancing the image of the casino.

It is still further an object of this invention to provide a casino chip that a casino patron will want to retain as a souvenir thus providing value to the casino.

These and other objects are preferably accomplished by providing a casino chip of a stated value having a central transparent portion with at least one discrete particle thereon, such as precious or semi-precious metallic or other moving elements. When shaken, the chip excites the player.

DESCRIPTION OF THE PREFERRED EMBODIMENT

Figure 1:
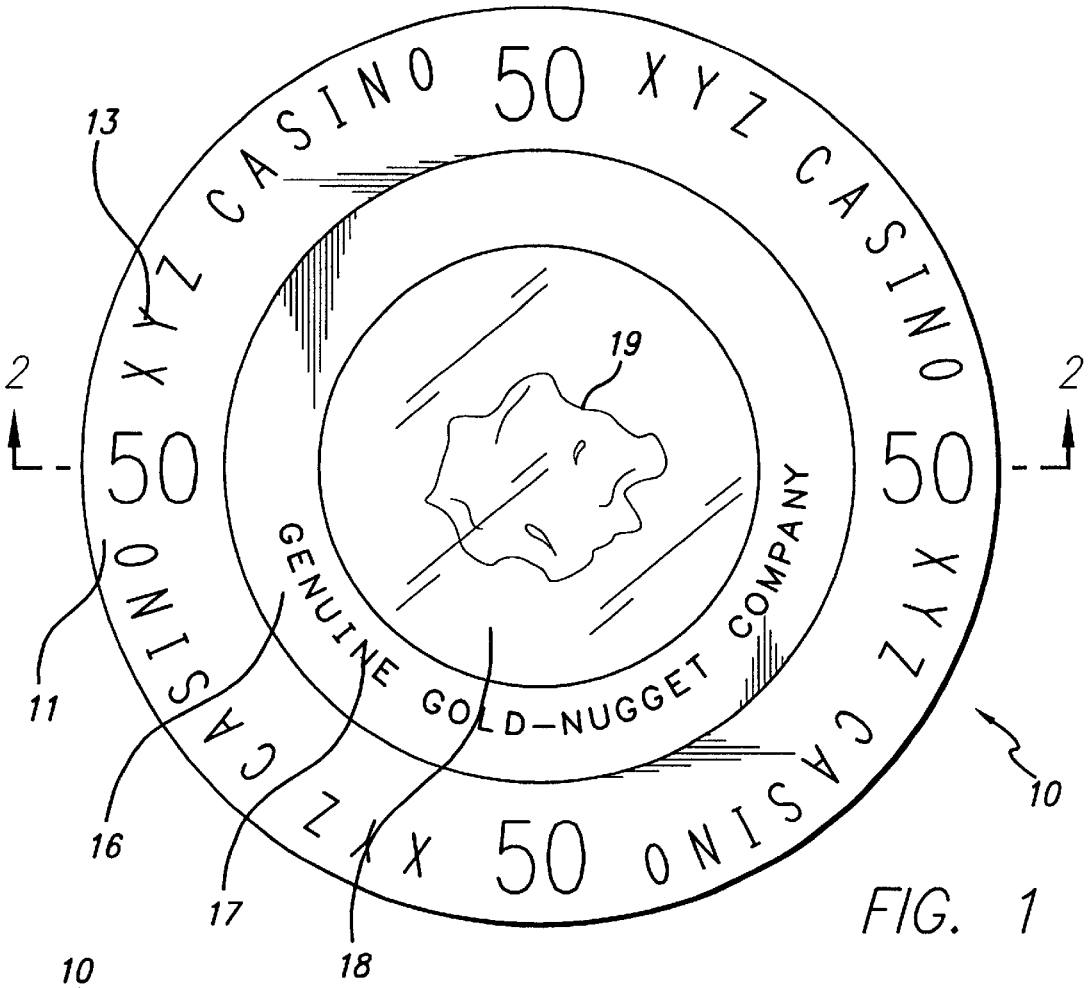
FIG. 1 is a top plan view of a casino chip in accordance with the teachings of the invention.

Referring now to FIG. 1 of the invention, a casino chip 10 in accordance with the teachings of the invention is shown. Chip 10 is generally cylindrical having an upper round surface 11 and a lower round surface 12 (FIG. 2) with an integral peripheral side wall 15. As seen in FIG. 1, indicia 13, which may be embossed or printed, is provided on the upper surface of chip 10. Such indicia 13 is provided on the main body portion 14 (see FIG. 2) surrounding a plastic or metallic retaining rim 16 which may also have indicia 17, raised or embossed or printed thereon, for indicating information concerning the contents of the transparent center chamber 18 as will be discussed.

Center chamber 18 may be of any suitable rigid transparent material, such as plastic, so that the inner contents are visible to the observer on both sides of chip 10. Chamber 18 may be bonded to rim 16 in any suitable manner, such as by gluing, or sonically sealing the same. In like manner, rim 16 is bonded to main body portion 14.

As particularly contemplated in the present invention, a discrete particle 19 is sealed within chamber 18 and loosely disposed therein. In the preferred embodiment of the invention, particle 19 is an actual gold nugget having an appreciable value. For example, if chip 10 has a casino playing value of $50, nugget 19 may have a corresponding value, that is, some nominal value that may vary with the face value of the chip.

Figure 2:
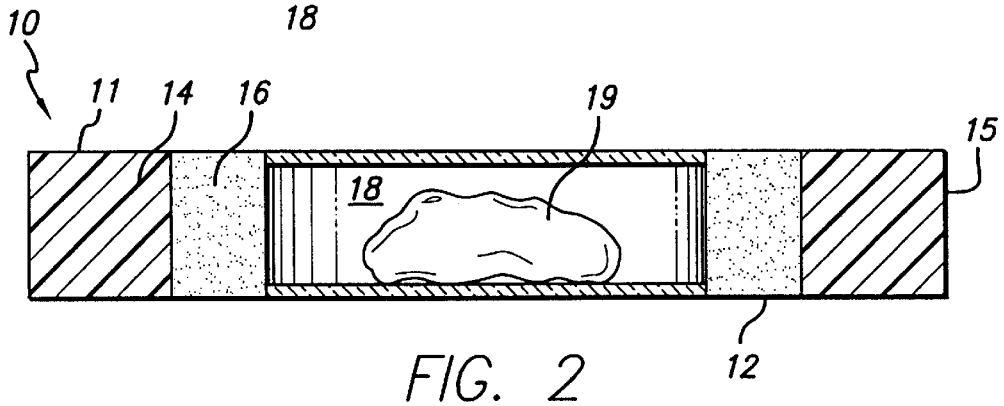
FIG. 2 is a view taken along lines 2—2 of FIG. 1.
Figure 3:
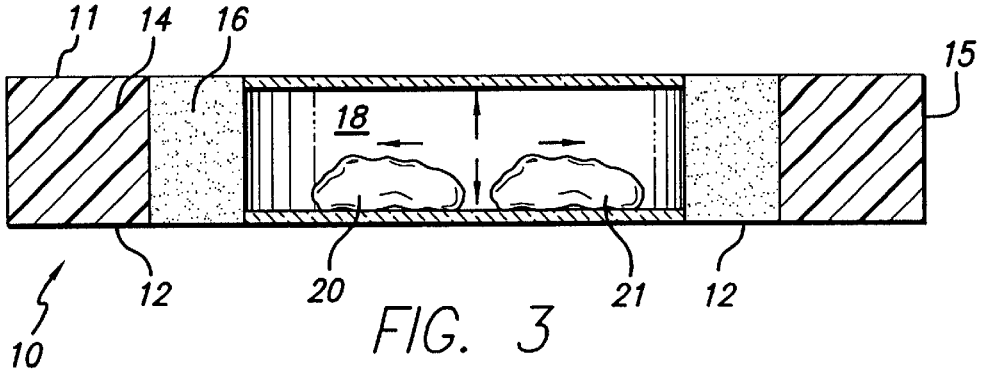
FIG. 3 is a view similar to FIG. 2 showing another embodiment of the invention.

Although a single discrete particle 19 is shown in FIGS. 1 and 2, as seen in FIG. 3, wherein like numerals refer to like parts of the embodiment of FIGS. 1 and 2, a plurality of discrete particles, such as particles 20, 21 may be provided within chamber 18. Such particles may also be gold nuggets, or other moving items.

Although only two particles are shown in FIG. 3, obviously a plurality of such particles, as 3 or more, may be provided. Further, although gold particles are preferred, any suitable precious or semi-precious or other materials, such as silver, goldbeaters sheet gold, a metal insert such as brass with real gold soldered thereto, etc., may be used.

In all cases, when a player shakes chip 10, the nugget 19 will rattle much like the clacking of a pair of dice. The player can thus shake the chip 10 for luck, then bet it adding interest and excitement to the game.

Figure 4:
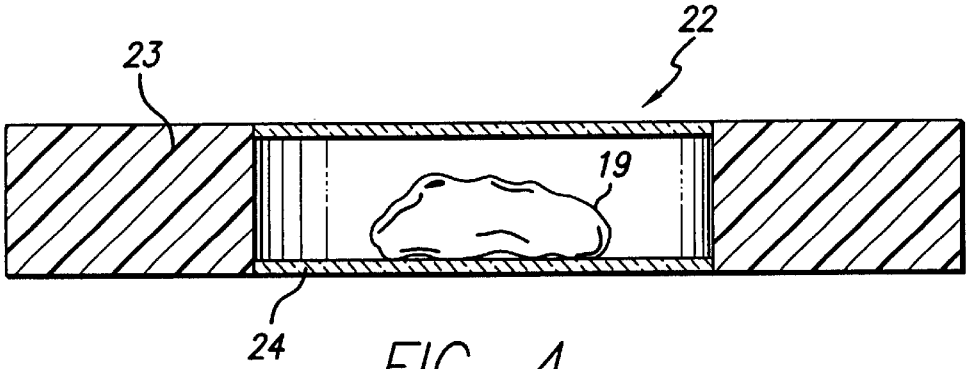
FIG. 4 is a side view in cross-section, similar to FIG. 2, showing another embodiment of a chip in accordance with the invention.

Although rim 16 and chamber 18 are disclosed as semi-cylindrical , obviously any suitable configuration may be used. Also, rim 16 may be eliminated and chip 10 may only have a main body portion with a central chamber. This is shown in FIG. 4 wherein chip 22 has a toroidally shaped main body portion 23 with a center chamber 24 sealed or otherwise secured to body portion 23 also having the discrete particle 19 of FIGS. 1 and 2 (or the plurality of particles 20, 21) of FIG. 3 therein. Chip 22 may also be provided with indicia similar to that shown in FIG. 1.

Figure 5:
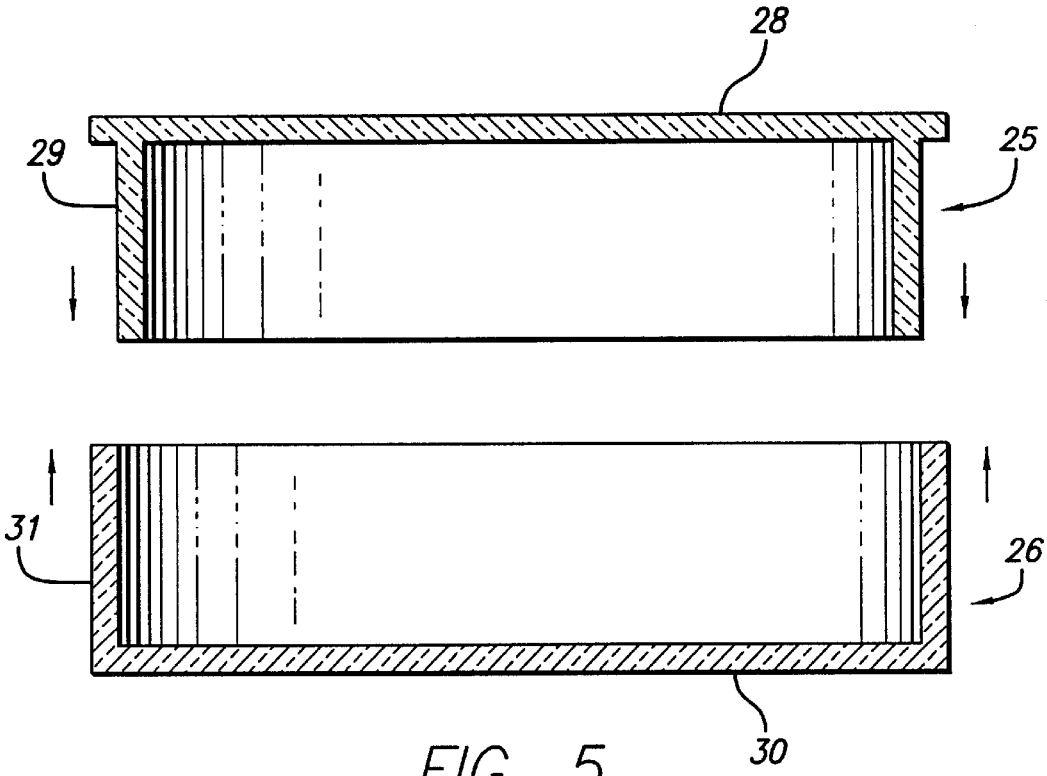
FIG. 5 is a side view of a pair of telescoping sections, in cross-section, used to form a part of the chip of FIGS. 1 to 4.
Figure 6:
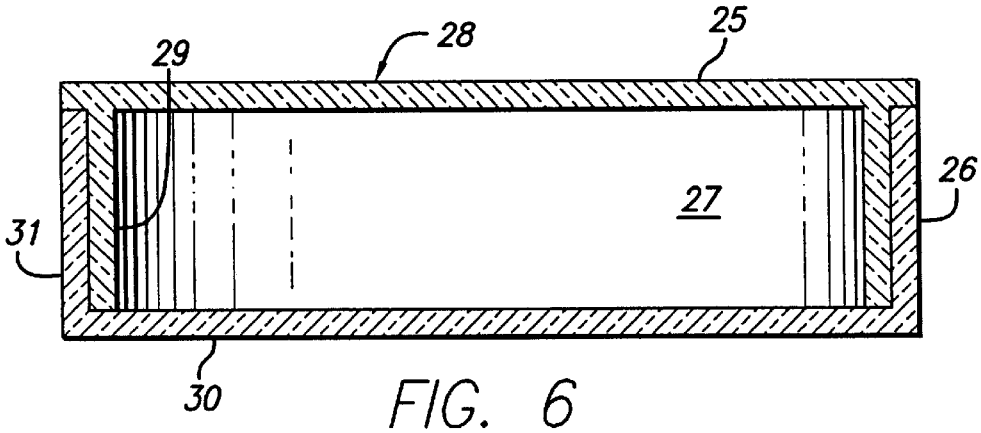
FIG. 6 is an assembled view of the sections of FIG. 5.

The main body portion 14, rim 16 and chamber 18 may be formed in any suitable manner known in the art. For example, as seen in FIGS. 5 and 6, chambers 18 and 24 may be formed of two separate telescoping parts 25 and 26, of a rigid transparent material, such as plastic, which telescope together and are sealed, as in FIG. 6, forming a central chamber 27 identical to chambers 18 and 24. Sealing means may be glue, a sonic seal, etc. Section 25 has an upper circular wall 28 with a downwardly extending integral sidewall 29 whereas section 26 has a bottom circular wall 30 with an upwardly extending integral sidewall 31. Wall 29 is of lesser outer diameter than wall 31 so they telescope together as seen in FIG. 6.

It can be seen that I have disclosed a casino chip that provides a chip that is "noisy" so that when the chip is shaken it will 'rattle', thus creating excitement in the gambler. A perceived 'real' value is added to the chip, thus enhancing the image of the casino using it. The public will want to retain the chip as a souvenir, thus not needing to redeem it in the casino using it thus also providing a value to the casino.

Although air may be the fluid within the chip chamber, any fluid, such as water, oil, etc. or the like may be used.

Further, although various particles can be used, the size and shape is irrelevant. For example, a casino could take a photograph of a patron and seal it within a chamber filled with air, oil, water, etc. The photograph would float or move within the chamber.

Although a specific embodiment of the invention is disclosed, variations thereof may occur to an artisan and the scope of the invention should only be limited by the scope of the appended claims.

I claim:

1. A casino chip comprising:

a generally toroidally shaped main body portion having an upper and lower surface with an interconnecting outer peripheral wall;

said main body portion having a hollow core surrounded by an inner peripherial wall;

a hollow sealed chamber fixedly mounted generally centrally within said toroidally-shaped main body portion housing core, said chamber being surrounded by said inner perpherial wall and having an upper and lower wall of a transparent material; and at least one discrete particle loosely mounted and movable within said hollow sealed chamber so that, when said chip is shaken, said particle abuts against the walls of said hollow sealed chamber providing a rattling sound.

2. The chip of claim 1 wherein said particle is a gold nugget.

3. The chip of claim 1 wherein said particle is a precious metal.

4. The chip of claim 1 wherein said particle is a semi-precious metal.

5. The chip of claim 1 wherein a plurality of discrete particles are disposed in said chamber.

6. The chip of claim 1 wherein printed matter is disposed on said chip.

7. The chip of claim 1 wherein said hollow sealed chamber is mounted within said main body portion by an annular rim fixed within said main body portion surrounding said chamber and sealed thereto.

8. The chip of claim 1 wherein said rim is of a metallic material.

9. The chip of claim 1 wherein said hollow sealed chamber is of plastic.

10. The chip of claim 1 wherein said hollow sealed chamber is formed of two telescoping sections sealed together.

* * * * *